US005529360A

United States Patent [19]

Black

[11] Patent Number: 5,529,360

[45] Date of Patent: Jun. 25, 1996

[54] PIPE LIFTING SLING ASSEMBLY AND LIFT DEVICE

[76] Inventor: Boyd C. Black, 140 Claren Dr., Heath, Ohio 43056

[21] Appl. No.: 447,115

[22] Filed: May 22, 1995

[51] Int. Cl.[6] ..... B66C 1/66

[52] U.S. Cl. ..... 294/89; 294/67.1

[58] Field of Search ..... 294/1.1, 67.1, 294/67.4, 74, 82.1, 86.4, 89–91, 93–97; 52/125.1, 125.2, 125.4

[56] References Cited

U.S. PATENT DOCUMENTS

| | | | |
|---|---|---|---|
| 416,246 | 12/1889 | Abrams | 294/91 |
| 1,562,148 | 11/1925 | Carlson | 294/91 X |
| 3,124,385 | 3/1964 | Neptune | 294/89 |
| 3,132,890 | 5/1964 | Beaudet | 294/97 X |
| 3,307,871 | 3/1967 | Russell et al. | 294/97 X |
| 3,420,014 | 1/1969 | Courtois et al. | 294/89 X |
| 3,626,508 | 12/1971 | Sharrow | 294/89 |

OTHER PUBLICATIONS

American Wire Rope & Sling, "Coffee Pot" Pipe Sling, brochure, No Date.

The Caldwell Co., "Pipe Carrier Lifting Sling", brouchure, Jan. 1, 1986.

*Primary Examiner*—Johnny D. Cherry

*Attorney, Agent, or Firm*—Charles F. Schroeder

[57] ABSTRACT

A pipe lifting steel wire cable sling and lift device principally for lifting concrete pipe sections provided with a central lift aperture through their wall, the sling having a centering ferrule about a lift ferrule for guiding the sling cable through the lift aperture and the lift device including a long handled slotted plate having a flared opening to its slot and being curved to conform to the interior of the pipe section to be lifted, the plate being backed by a matching slotted back plate having a pocket region at the end of its slot for holding the lift ferrule therein during pipe lifting operations.

17 Claims, 3 Drawing Sheets

PIPE LIFTING SLING ASSEMBLY AND LIFT DEVICE

FIELD OF THE INVENTION

This invention is a lift sling assembly and lift device for lifting large sections of heavy pipe, such as sections of concrete sewer pipe designed for conveyance of fluids, the sling being adapted to lift such pipe sections with on-site cranes during laying of pipe sections as in trenches.

BACKGROUND

Slings used for lifting heavy pipe sections are usually wire cable slings. To lift a pipe section, the end of the sling cable is passed through an aperture in the wall of the pipe located centrally along the length of the pipe section. In prior art arrangements the end of the sling is secured at the inside wall of the pipe section such as with fingers or vanes which extend radially outwardly from the cable following entrance through the wall aperture. In other arrangements, lift plate members larger in size than the diameter of the aperture can be secured to the end of the cable following entry through the pipe wall. The cable is then drawn upwardly, such as with a crane, to lift the pipe section. One such arrangement involves placement of a short handled slotted flat lift plate in surrounding relation with a cable above a lift ferrule at its end. Thus when the sling is lifted the ferrule bears against the lift plate which in turn bears against the interior wall surface of the pipe section as it is being lifted. In utilizing such arrangements for lifting pipe sections, the radially extending lift devices frequently damagingly gouge into the interior wall of the pipe adjacent the lift aperture.

SUMMARY OF THE INVENTION

According to the present invention a lift plate member is provided having a curved shape conforming to the interior curvature of the pipe section to be lifted. The lift plate member is provided with an extended elongate handle which enables safe manual placement of the lift plate in engaging relation with the end of the cable on the interior of the pipe. The lift plate can be installed on the end of the lift cable from an end of the pipe section without requiring the installing person to be physically in close proximity to the cable on the interior of the pipe. In other words, the lift plate because of its elongate handle can be inserted safely in engaging relation with the lift ferrule at the end of a lift sling from a remote location.

The lift plate has a slot extending from an edge toward the plate center. The width of the slot is just adequate to accommodate the cable and allow the plate to be advanced to a centered surrounding relation with the end of the cable. A novel aspect of the invention is that the slot in the lift plate is provided with a flared entry opening. The flared entry facilitates lateral guidance of the plate in proper relation with the lift cable for advancement of its slot in proper surrounding relation with the cable. The flared entry allows manual feeling at the handle of the desired engaging association of the lift plate with the cable and allows sliding the plate into proper lift position with less need by the installer for clear sighting of the end of the cable.

Another novel aspect of the invention is the provision of a centering ferrule along the length of the cable in a position where during lifting it will be located within the lift aperture thereby promoting straight passage of the cable through the aperture during lifting of the pipe with little possibility of gouging contact of the cable with the sides of the lift aperture.

It is a principal object of the present invention to provide a lift sling assembly for lifting heavy concrete pipe sections or metal pipe sections in which the lift plate is easily and safely installed in proper lifting association with a lift sling from a remote location with a minimum possibility of error.

Another object of the invention is to provide a lifting sling assembly which is capable of bearing extremely large pipe section loads with minimum or no likelihood of damage to the interior wall of the pipe, or the sides of the lift aperture through which the lift cable is passed.

A feature of the invention is the ease with which the lift plate can be placed in proper association with the end of the lift cable passed through a lift aperture in the pipe wall.

Still another feature of the invention is the shape of the cable entry to the lift plate slot for proper centering of the cable in the lift plate upon passage through the lift aperture, thereby assuring reliable positioning for handling full capacity loads with a minimum potential for damage to the pipe sections during lifting operations.

Other objects and features which are believed to be characteristic of my invention are set forth with particularity in the appended claims. My invention, however, both in organization and manner of construction, together with further objects and features thereof, may be best understood with reference to the following description taken in connection with the accompanying drawings.

DETAILED DESCRIPTION

Figure 1:
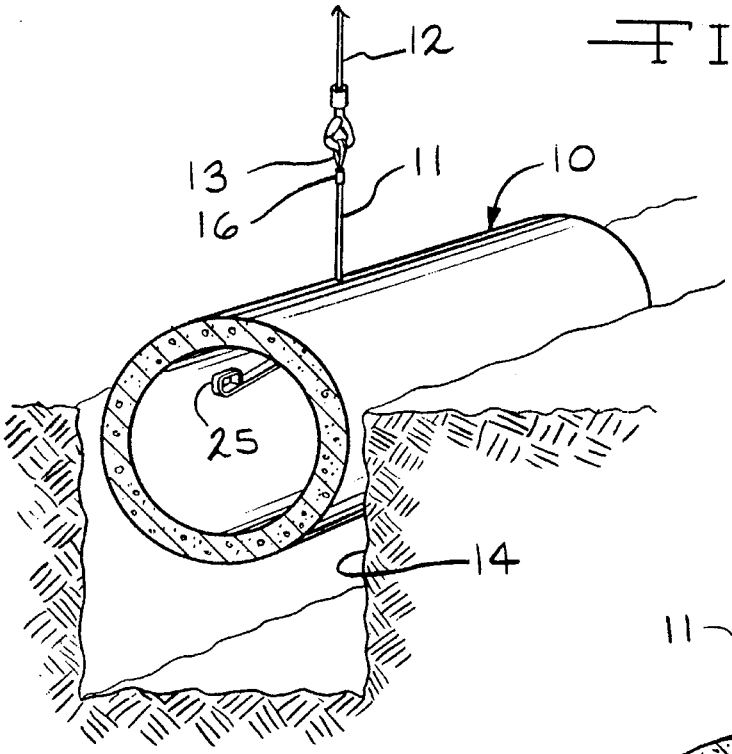
FIG. 1 is a general broken away perspective view of a concrete sewer pipe section being deposited in a trench utilizing a pipe lifting assembly of the present invention.

Referring to the drawings in greater detail, FIG. 1 shows a concrete pipe section 10 suspended by a lift sling assembly 11 of the present invention held by crane hook 12 as the pipe section is being deposited in a trench 14 during laying of a length of sewer pipe.

Figure 2:
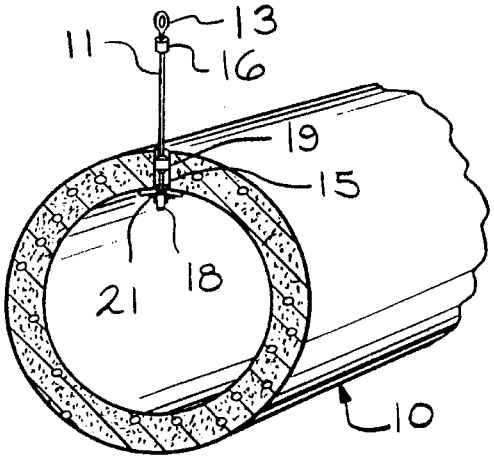
FIG. 2 is an enlarged cross-sectional view of the pipe section of FIG. 1 illustrating how the lift sling extends through an aperture in the top of the pipe section to establish a lifting relation therewith.

FIG. 2 illustrates in greater detail how the lift sling 11 supported by the crane hook 12 is associated with a lift plate 20 during lifting operations. The hook 12 engages a lift thimble 13 at the lifting end of the sling assembly. The end of the cable 11 surrounds the thimble 13 and is machine spliced at a ferrule 16 to form a heavy duty thimble eye for engagement by the crane hook 12. A hole or aperture 15 is provided in a central location along the length of the pipe section 10, the aperture extending through the wall 17 of the pipe section through which the end of the cable 11 can be passed for engagement by the lift plate 20.

The lift plate 20 is assembled with a strength increasing backing plate 21 having a cup-like cavity shaped to accommodate a lift ferrule 18 at the end of the cable 11. A feature of the invention is that the profile of the lift plate 20 is arcuately with a convex top or lift surface shaped to conform to the curvature of the interior wall of the pipe section 10. The curved shape of the lift plate distributes the load pressure in the area of contact with the pipe wall and thereby increases the capability of the sling assembly to handle heavy loads. Also with such shaping, potential for gouging of the interior wall surface of the pipe in regions adjacent the lift aperture 15 is minimized or eliminated.

Figure 3:
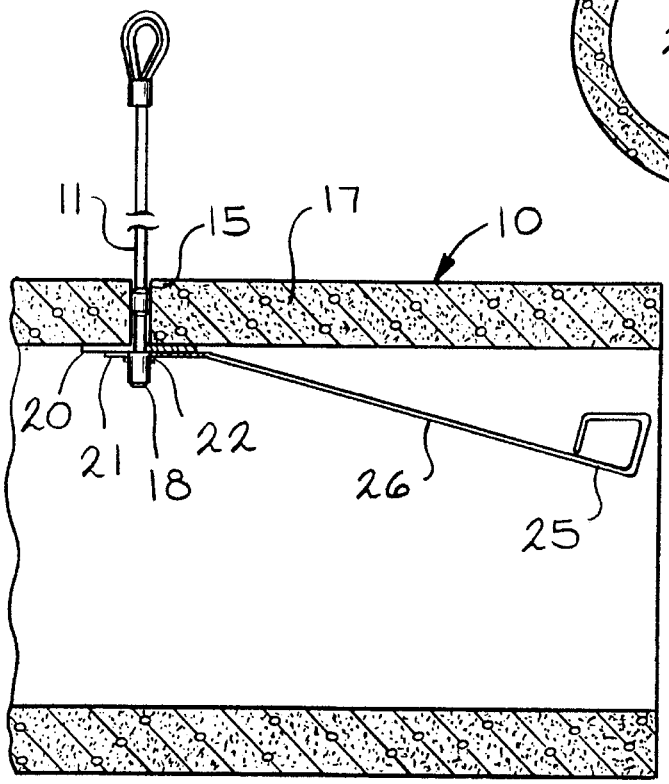
FIG. 3 is a broken away cross-sectional view of the pipe section of FIGS. 1 and 2 illustrating how the pipe lifting relation is established with a handled lift plate device of the present invention.
Figure 4:
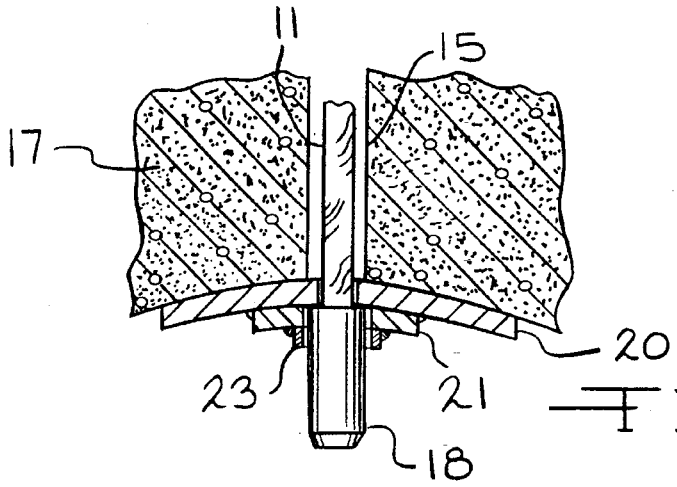
FIG. 4 is an enlarged cross-sectional, broken away view of the lift plate unit of the present invention and its association with the lift cable passing through the lift aperture of the pipe section illustrated in FIG. 2.

Proper orientation of the lift plate 20 to match the curvature of the pipe interior surface is accomplished by providing it with an elongate arm 26 for inserting the lift plate 20 from an end region of the pipe section as illustrated in FIG. 3. The extended arm 26 is joined to both the lift plate 20 and the backup plate 21 such as by being welded thereto. The arm 26 is provided at its other end with a hand grippable handle 25 which permits manual establishment of a lifting relation of the lift plate assembly with the end of the cable 11 from either end of the interior of the pipe section. Matched alignment of the curvature of the lift plate 20 with respect to the interior of the pipe section is thereby effected with little need for special attention.

The lift plate 20 is provided with a slot 30 into which the cable 11 is inserted to establish a centering relation of the cable with the lift plate. The slot is slightly larger in width than the diameter of the cable to permit the plate to be slid over the cable for centering of the cable in the mid region of the lift plate. The slot is shown more clearly in the illustration of the bottom of the lift plate assembly in FIG. 6 which also shows the arm 26 extending diametrically away from the slot. The convex curvature of the top surface of the plate 20 which contacts the interior of a pipe section during lifting is aligned to be bisected by the diametric line through the plate 20 at the slot 30 and handle 26. In this regard, the curve falls slightly downward away on both sides of the diametric line.

The end of the cable is provided with a cylindrical shaped end or lift ferrule 18 of diameter greater than the width of the slot 30 so that its top end can bear against the shoulders provided at the end of the slot 30 to establish the desired lifting engagement of the ferrule 18 with the lift plate 20. The backing plate 21 also is slotted but is provided with a larger diameter pocket 22 at its central end region to snugly accommodate the lift ferrule 18 in pocketed relationship therein. In other words, the slot in the backing plate 11 terminates in an enlarged circular pocket region 22 of diameter which will accommodate the end ferrule 18 in pocketed relation so that it cannot slide out of the slot 30 during lifting operations but will be held therein by the walls of the backing plate 20 in the pocket 22. To increase the depth of the pocket region as well as its wearability, a special raised pocket sleeve 23 made of a C-shaped ring of hardened steel about ⅜ to ½ inch thick is provided in weld secured relation above the entry to the pocket 22. As an alternate the sleeve can extend through the depth of the backing plate 21. The pocket sleeve conforms to the internal dimensions of the pocket 22 but extends slightly above the external surface of the pocket to provide a greater length for accommodation of the ferrule 18 than is present in the thickness of the backing plate 21 alone. Thus further assurance is provided for holding the lifting ferrule 18 in the pocket region of the plate 21 during lifting operations.

Another feature of the invention is the provision of a guide or centering ferrule 19 about the cable 11 in spaced relation above the lifting ferrule 18 such that it is located within the thickness of the wall 17 in the aperture 15 during lifting operations. The ferrule 19 is of diameter which fits snugly but freely in the aperture 15 to permit its free insertion therein during establishment of the lifting relation of the lifting ferrule 18 with the lift plate 20. The ferrule 16 acts as a guide to assure a straight aligned passage of the cable 11 through the aperture 15 through the wall 17. The centering ferrule also serves to arrest the unlaying of the wire rope caused by the manual turning of the load to align the pipe during actual placement in the excavated trench. This ferrule prevents distortion of the wire rope from effecting the lifting ferrule. That is, cocking of the cable and direct contact of the steel cable with the aperture 15 can be avoided to further reduce the potentials for damage of the concrete walls during lifting operations. The ferrule can be provided with bevelled or tapered edges 28 both at its top and bottom as may be seen in FIG. 7 to permit greater ease of its insertion in the aperture 15 without causing damage to the interior walls of the aperture by otherwise abrupt squared edges of the ferrule 19 in the aperture 15. Similarly the bottom end of the lifting ferrule 18 can be provided with a bevelled edge 29 to assure smoother passage of the lift ferrule through the aperture 15 prior to establishment of its engaging relation with the lift plate assembly 20–21.

Figure 5:
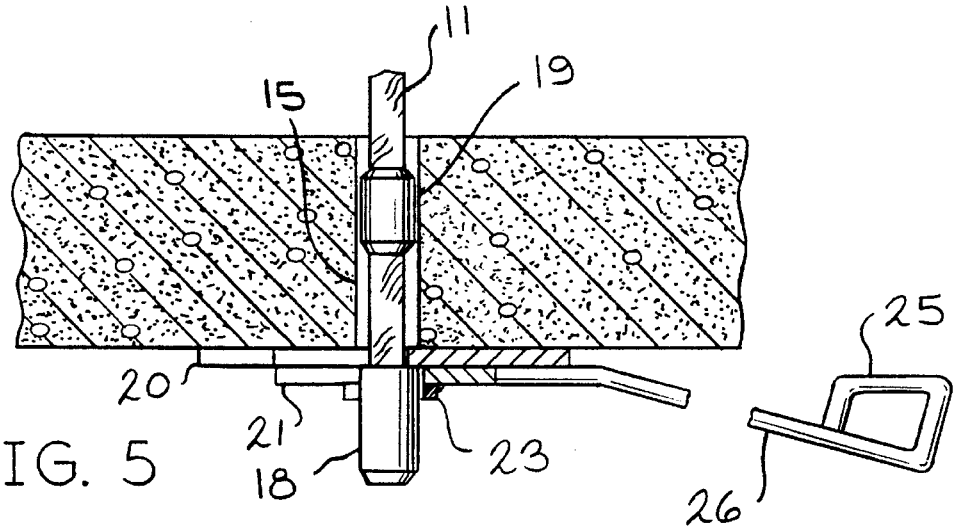
FIG. 5 is an enlarged view of the handled lift plate device shown in use in FIG. 3.

FIG. 5 illustrates the lift plate assembly 20–21 with its extended arm 26 and handle 25 showing in more detail how the end ferrule 18 resides in pocketed relation within the pocket 22 and its sleeve 23 during lifting operations and how the ferrule 18 bears against the shoulders of the slot of the lift plate 20 during lifting operations.

Figure 6:
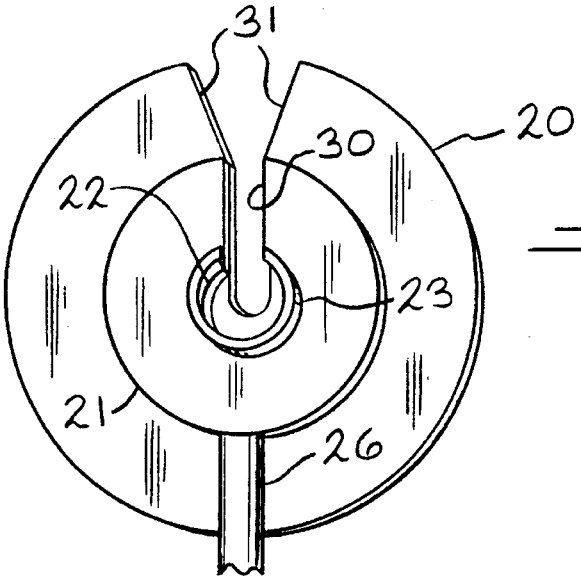
FIG. 6 is an enlarged view of the bottom of the lift plate shown in FIG. 5 illustrating a pocket in which the lift ferrule at the end of the cable resides during pipe lifting operations.

FIG. 6 illustrates in still greater detail how the backing plate 21 is associated with the lift plate 20 to provide a pocket region 22 with a raised pocket sleeve 23 for the lifting ferrule 18 of the sling assembly FIG. 6 illustrates still further how the slot 30 in the lift plate assembly is provided with a flared opening 31 to facilitate guidance of the plate into engaging relation with the lift cable 11 as the plate is placed in lifting association with the cable. The entry 31 is wider than the cable dimension at the outer periphery of the plate 20 and narrows progressively to the width of the slot 30 generally at the outer periphery of the backing plate 21. The extended arm 26 of the lift plate assembly extends in the direction opposite to that of the flared opening 31. Thus when the lift plate assembly is guided into association with the lift cable 11 at the lifting ferrule 18, the curvature of the lift plate 20 conforms in proper alignment with the curvature of the interior surface of the pipe section when the insertion is made from an end region of the pipe section. That is, matching of the convex top surface of the lifting plate assembly with the concave interior surface of the pipe interior (as may be seen clearly in FIG. 2) is assured by engaging the lift cable 11 with the flared opening 31 of the lift plate 20 and then guiding the lift plate assembly progressively forward for central engagement of the lift cable 11 with the end of the slot 30 in the center of the lift plate assembly. As the lift assembly is moved to center to place the cable 11 in the base of the slot 30, the pocket region 22 in the backing plate 21 is aligned with the lift ferrule 18. The pocket 22 has a slightly larger diameter in the backing plate 21 than the lift ferrule 18 such that the lift ferrule can reside in snug fit relation therein during lifting operations.

Figure 7:
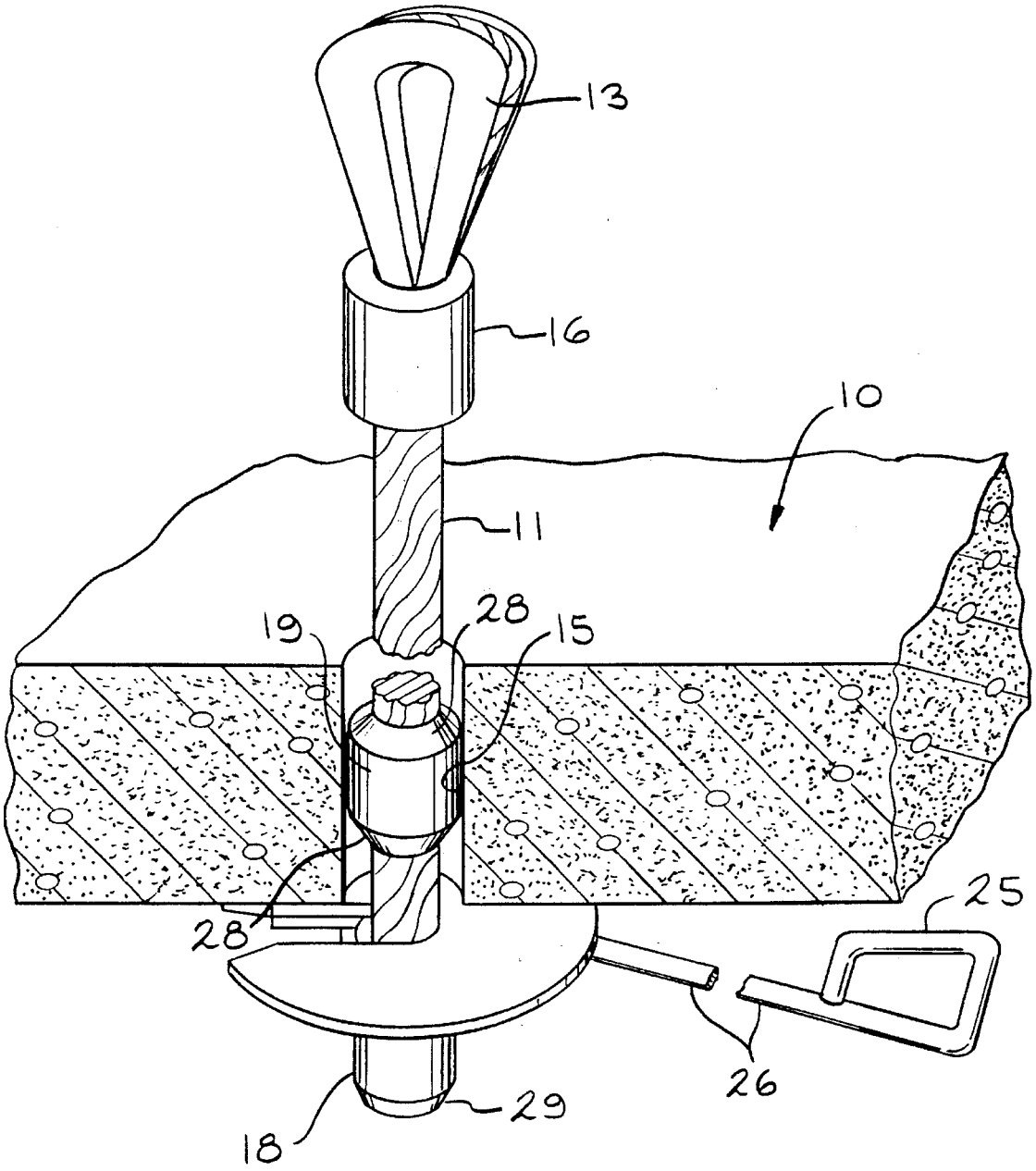
FIG. 7 is a broken away illustration of the entire pipe lifting sling assembly and lift plate unit as they are associated with a pipe section during lifting operations.

The lift association of the end ferrule 18 with the lift plate assembly is shown more clearly in FIG. 7 in which the centering ferrule 19 is shown residing within the aperture 15 through the pipe wall 17. The centering ferrule 19 is preferably arranged to be positioned within the aperture 15 about two-thirds of the way up from the lift plate 20 to assure a straight line guidance of the cable through the aperture 15.

The lift plate assembly can be placed in lifting engagement with the sling cable 11 by in a sense feeling the proper positioning of the plate assembly with the cable from the handled end 25 of the extended extension arm 26. Close manual handling of the plate assembly with the cable 11 near its end ferrule 18 can be avoided in situations which might otherwise entail close dangerous hand manipulation of an end plate with the cable during establishment of lifting relations with the assembly.

To place the lift sling assembly in use, the lifting ferrule 18 of the sling is passed through the center hole 15 of the pipe to be lifted. The lift plate assembly 20–21 is then slid into position with the cable, and the lift ferrule 18 is located in the pocket sleeve 23 of the back plate 21. Lift tension then secures the lift sling and lift plate assemblies to the pipe section to be lifted. When the pipe section is located in position for deposit, release of tension on the sling enables quick removal of the lift device from the end of the sling by pulling on the lift plate handle 25 from a safe location a distance from the lift cable.

Although used principally with concrete pipe, the invention can be used to lift composition material pipe sections or steel or other metallic pipe as well. Concrete pipes are usually in the order of 8 to 10 feet in length with a 4 to 16" wall thickness. Accordingly, by way of example, when the lifting aperture is in the center of the length of pipe, the handle for the lift plate assembly, which can be made of round rod about ¾" in diameter, can extend at an angle of approximately 15 degrees to the horizontal for about 4 or 5 feet to the end region of the pipe section to be lifted.

The lifting plate assembly is usually circular and, by way of further example, may be about 9 to 10 inches in overall diameter with the backing plate about 5 to 6 inches in diameter. The plates 20 and 21 are made of steel about ¾ to 1 inches thick. The slot 30 extending to the center region of the plate assembly is about 1 to 1¾ inches in width to accommodate cables of diameter generally of ¾ inches to 1½ inches. The flared entry opening 31 can be about 2¼ inches wide extending to the width of the cable slot. The lifting ferrule 18 at the end of the cable 11 may have a length about 5 inches and a diameter of 2 to 2 ¼ inches such that it is greater in diameter than the width of the slot in the lift plate which it is to engage. The pocket region 22 in the backing plate 21 is correspondingly made slightly larger in diameter than the lift ferrule 18 such that the lift ferrule, in a sense, will be locked in the pocket region during lifting operations.

As examples in the range of tonnage which can be lifted with the sling assembly of the present invention, a ¾ inch diameter cable sling can be made to lift a 5 ton pipe section with a 5 to 1 safety factor as required by A.N.S.I. and O.S.H.A. codes, whereas a wire rope 2" in diameter can be made to lift pipe sections weighing up to 37 tons. Multiple lift sling arrangements can be utilized to lift larger size loads. All sling assemblies are load checked before shipment for use.

The lift plates can be made to different curvatures and the slings made to different lengths dependent upon the dimensions of the pipe sections to be lifted. In this regard the curvature world be greater for smaller diameter pipes to permit matching of the plate to the sharper curvature of the smaller diameter pipe sections.

In view of the foregoing it will be understood that many variations of the arrangement of my invention can be provided within the broad scope of principles embodied therein. Thus, while a particular preferred embodiment of my invention has been shown and described, it is intended by the appended claims to cover all such modifications which fall within the true spirit and scope of the invention.

I claim:

1. A pipe lifting sling assembly including a lift device for lifting sections of heavy pipe which are provided with a lift aperture extending through the wall of the pipe section comprising a lift cable having a lift ferrule fixed at its end of size for passage through a lift aperture to the interior of a pipe section to be lifted, a lift plate for lifting said pipe section upon engagement with said lift ferrule on the interior of said pipe section, said lift plate having a slot for accommodation of said cable and lift ferrule in the center of said plate extending from the outer periphery to the central region of said plate, said slot being slightly wider than the diameter of said cable but narrower than said lift ferrule whereby said lift ferrule will engage said plate at the sides of said slot during pipe lifting operations, said slot having a flared lift cable entry spreading out to said outer periphery of said plate for guiding said plate into engagement with said cable to place said cable in the center of said plate for lifting operations.

2. A pipe lifting sling assembly as set forth in claim 1 in which said lift plate is provided with a longitudinal handle arm fixed thereto to facilitate placement of said plate in engagement with said lift cable.

3. A pipe lifting sling assembly as set forth in claim 2 in which said handle arm extends in alignment with said slot in a direction opposite the entry to said slot.

4. A pipe lifting sling assembly as set forth in claim 1 in which said lift plate is provided with a backing plate having a cable slot matched in width and orientation with said lift plate slot.

5. A pipe lifting sling assembly as set forth in claim 4 in which said backing plate has a pocket formed at the central region of said plate of size to accommodate said lift ferrule in pocketed relation during lifting contact with said lift plate.

6. A pipe lifting sling assembly as set forth in claim 5 in which said pocket is provided with a raised upper edge to increase the effective depth of said pocket.

7. A pipe lifting sling assembly as set forth in claim 6 in which said raised upper edge for said pocket is provided by a liner within said pocket protecting upward from said pocket.

8. A pipe lifting sling assembly including a lift device for lifting sections of heavy pipe which are provided with a lift aperture extending through the wall of the pipe section comprising a lift cable having a lift ferrule fixed its end of size for passage through a lift aperture to the interior of a pipe section to be lifted, a lift plate for lifting said pipe section upon engagement with said lift ferrule on the interior of said pipe section, said lift plate having a slot for accommodation of said cable and lift ferrule in the center of said plate extending from the outer periphery to the central region of said plate, said slot being slightly wider than the diameter of said cable but narrower than said lift ferrule whereby said lift ferrule will engage said plate at the sides of said slot during pipe lifting operations, said slot having a flared lift cable entry spreading out to said outer periphery of said plate for guiding said plate into engagement with said cable to place said cable in the center of said plate for lifting operations, said lift plate being curved in matched relation to the curvature of the inside surface of the pipe section which it is to lift.

9. A pipe lifting sling assembly for lifting thick walled concrete pipe sections which are provided with a lift aperture extending through the wall of the pipe section comprising, a lift cable having a lift ferrule at its end of size for passage through a lift aperture to the interior of a pipe section to be lifted;

a lift plate for lifting said pipe section upon engagement with said lift ferrule on the interior of said pipe section and a centering ferrule on said cable spaced from said lift ferrule a distance such that during lifting of said pipe section said centering ferrule is located within said lift aperture, said centering ferrule being of size to fit snugly but freely within said lift aperture whereby said cable will pass in substantially straight line relation through said aperture during lift operations with little likelihood of damage to the wall of said pipe section from distortion of said cable during lifting operations.

10. A pipe lifting sling assembly for lifting thick walled concrete pipe sections which are provided with a lift aperture extending through the wall of the pipe section comprising, a lift cable having a lift ferrule at its end of size for passage through a lift aperture to the interior of a pipe section to be lifted;

a lift plate for lifting said pipe section upon engagement with said lift ferrule on the interior of said pipe section and a centering ferrule on said cable spaced from said lift ferrule a distance such that during lifting of said pipe section said centering ferrule is located within said lift aperture, said centering ferrule being of size to fit snugly but freely within said lift aperture whereby said cable will pass in substantially straight line relation through said aperture during lift operations with little likelihood of damage to the wall of said pipe section from distortion of said cable during lifting operations, said lift ferrule having a bevelled bottom edge to facilitate insertion and passage through said lift aperture.

11. A pipe lifting sling assembly as set forth in claim 10 in which said centering ferrule is also provided with a bevelled top edge to facilitate its insertion and passage in said lift aperture.

12. A pipe lifting device for lifting sections of heavy pipe which are provided with a lift aperture extending through the wall of the pipe section through which the end of a lift cable having a lift ferrule fixed at its end can pass, said lifting device comprising a lift plate having a slot extending from its outer edge to the center region of said lift plate, said slot being slightly wider than the diameter dimension of said cable but less than the dimension of said lift ferrule whereby said lift plate can be arranged to engage said cable within said slot for central lifting alignment of said cable with said plate, said slot having a flared cable entry wider at its outer peripheral edge than said slot, said flared entry from said outer edge narrowing to the width of said slot to facilitate establishment of a lifting engagement of said lift plate with said lift cable.

13. A pipe lifting device as set forth in claim 12 in which said lift plate is provided with a longitudinal handle arm fixed thereto to facilitate placement of said lift plate in lifting engagement with said lift cable from a distance from said cable.

14. A pipe lifting device as set forth in claim 13 in which said handle arm extends in alignment with said slot in a direction opposite the entry to said slot.

15. A pipe lifting device as set forth in claim 12 in which said lift plate is provided with a backing plate having a cable slot matched in width and orientation with the slot in said lift plate.

16. A pipe lifting device as set forth in claim 15 in which said backing plate is provided with a pocket for said lift ferrule formed at the central region of said lift plate to accommodate said lift ferrule in pocketed relation during lifting contact with said lift plate.

17. A pipe lifting device for lifting sections of heavy pipe which are provided with a lift aperture extending through the wall of the pipe section through which the end of a lift cable having a lift ferrule fixed at its end can pass, said lifting device comprising a lift plate having a slot extending from its outer edge to the center region of said lift plate, said slot being slightly wider than the diameter dimension of said cable but less than the dimension of said lift ferrule whereby said lift plate can be arranged to engage said cable within said slot for central lifting alignment of said cable with said plate, said slot having a flared cable entry wider at its outer peripheral edge than said slot, said flared entry from said outer edge narrowing to the width of said slot to facilitate establishment of a lifting engagement of said lift plate with said lift cable, said lift plate being curved in matched relation to the curvature of the inside surface of the pipe section which it is to lift.

* * * * *